United States Patent [19]

Lad et al.

[11] Patent Number: 4,749,511

[45] Date of Patent: Jun. 7, 1988

[54] CONTACT LENS CLEANING SOLUTIONS CONTAINING ENDOPROTEINASE LYS-C

[75] Inventors: Pushkaraj J. Lad, San Mateo; Leslie R. Woodhouse, Walnut Creek, both of Calif.

[73] Assignee: Genencor, Inc., South San Francisco, Calif.

[21] Appl. No.: 892,528

[22] Filed: Jul. 31, 1986

[51] Int. Cl.[4] ..... C11D 7/42; C11D 3/386; D06M 16/00

[52] U.S. Cl. ..... 252/174.12; 252/DIG. 12; 435/42; 435/219; 435/220; 435/221; 435/222; 435/264

[58] Field of Search ..... 435/262, 264, 221, 222, 435/220, 219; 436/89, 90

[56] References Cited

U.S. PATENT DOCUMENTS 4,414,332 11/1983 Schrenk et al. ..... 435/219
4,511,490 4/1985 Stanislowski et al. ..... 252/174.12

*Primary Examiner*—Paul Lieberman
*Assistant Examiner*—Kathleen Markowski
*Attorney, Agent, or Firm*—James G. Passe

[57] ABSTRACT

Contact lens cleaning compositions and a method which comprises treating soft contact lenses with general purpose proteases in combination with endoproteinase lys-C are effective in dissolving away and hydrolyzing lysozyme, the major protein component of tears.

10 Claims, No Drawings

CONTACT LENS CLEANING SOLUTIONS CONTAINING ENDOPROTEINASE LYS-C

TECHNICAL FIELD

The invention relates to compositions useful for cleaning contact lenses. In particular, it relates to methods to remove proteinaceous materials from the lenses using compositions having protease active ingredients.

BACKGROUND OF THE INVENTION

The advent of soft contact lenses containing hydrophilic polymers had led to greatly increased comfort and usability. However, concommitantly with these improvements, the related problem of proteinaceous material absorbed into the lens, causing opaqueness, and sometimes infection, has arisen. Because soft contact lenses absorb up to approximately 150% of their weight in water, this absorbed liquid carries with it the protein content of tears, which protein content, over relatively short periods of time, results in lens opacity.

Since it was known that a major contributor to the opacity problem was, in fact, proteinaceous, it was logical to propose the use of proteases in cleaning solutions. Indeed, U.S. Pat. No. 3,910,296 discloses and claims the use of protease-containing solutions for soft contact lens cleaning. In addition, this disclosure suggests the use of sulfhydryl-group-containing compounds to "activate" the protease, presumably by reduction of the disulfide bonds contained in it.

A fair number of disclosures have sought to improve on the basic idea of a protease-containing cleaner, either by suggesting additions of other substances to the cleaning solution or by adjusting the conditions under which cleaning occurs, or both. For example, U.S. Pat. No. 4,096,870 suggests the use of a mixture of proteases with carbohydrases and lipases, such as that found in the digestive aid pancreatin. Addition of boric acid and sodium chloride to the cleaning composition is also suggested. U.S. Pat. No. 4,285,738 suggests the use of a hypertonic solution of urea and/or a guanidine salt in addition to the protease. This composition also contains a sulfhydryl compound or other reducing agent capable of cleaving disulfide bonds. British patent No. 2,019,721 is directed to cleaning compositions containing lipolytic enzymes in phosphate buffer. These compositions may also contain a proteolytic enzyme. Similar compositions are disclosed in British patent No. 2,029,225, European patent No. 5131, and Canadian patent No. 1,146,881. Mixtures of a protease with nonionic wetting agents are suggested in German application No. 2,854,278, published Mar. 7, 1980. A foaming version of a cleaner-containing protease is suggested by Japanese application No. 57/048,712, published Mar. 20, 1982, and the combination of papain and lactose in cleaning compositions is disclosed in British application No. 2,088,581, published Sept. 6, 1982.

Solutions which are free of "activators"—i.e., which do not contain sulfhydryl compounds capable of cleaving disulfide bonds—are disclosed in European patent application No. 140,669, published Aug. 5, 1985. These compositions contain protease extracts from various bacteria, such as bacillus, streptomyces, or aspergillus, and thus contain a variety of proteases, as well as, in some embodiments, amylase and lipases. European patent application No. 141,607, published May 15, 1985, improves on the basic proteolytic process by altering the treatment conditions by conducting the cleaning at an increased temperature. Particularly adaptable to cleaning carried out at these increased temperatures may be the heat-stable enzyme mixtures disclosed in PCT application No. 85/03247, published Jan. 8, 1985. These compositions contain such enzymes as thermolysin, caldolysin, and endopeptidase extracted from bacillus. Japanese application No. 60/196,722 discloses the mixture of amphoteric surfactants with various hydrolases, including proteases.

As with most applications, it is desirable to have available a variety of possible cleaning solutions, some of them better for particular lens compositions than others. The present invention offers another member of this group wherein the proteolytic activity of the basic protease content of the composition is improved by the addition of enzyme capable of exposing a target protein, lysozyme, for further cleavage.

DISCLOSURE OF THE INVENTION

The invention provides a cleaning composition which renders the main protein component of tears, lysozyme, particularly susceptible to attack by proteases. By including in the composition an endopeptidase which specifically cleaves at the carboxyl terminus of lysine residues, exposure of the susceptible peptide bonds of lysozyme to an accompanying protease is achieved without concomitant inactivation of the protease itself. Additional ingredients of the composition may include buffers and stabilizers, detergents and disulfide cleavage reagents.

Accordingly, in one aspect, the invention relates to a contact lens cleaning composition which comprises a proteolytic enzyme effective in cleaving peptide bonds of lysozyme, in combination with an endoproteinase specific for peptide bonds at the carboxyl terminus of lysine residues. In another aspect, the invention relates to methods of cleaning contact lenses using the compositions of the invention, and to methods of preparing these compositions.

MODES OF CARRYING OUT THE INVENTION

A. Definitions

As used herein, "lys-C" refers to an endoproteinase which hydrolyzes peptide bonds on the carboxyl side of lysine residues. Similarly, endoproteinases designated "arg-C" hydrolyze peptide bonds on the carboxyl side of arginine residues. Endoproteinase "lys-C" is available from *Lysobacter enzymogenes* (Jekel, P. A., et al, *Anal Biochem* (1983) 134:347–354), from *Achromobacter lyticus* (M497-1) (Masaki, T., et al, *Agric Biol Chem* (1978) 42:1443–1445), and from Myxobacter, Strain AL-1 (Wingard, M., et al, *J Bact* (1972) 112:940–949). Endoproteinase "arg-C" has been extracted from mouse submaxillary glands (Schenkein, I., et al, *Science* (1968) 159:640–643; Schenkein, I., et al, *Arch Biochem Biophys* (1977) 182:64–70).

"Protease", in general, as used herein, refers to general purpose proteases such as papain, the proteases contained in pancreatin, trypsin, chymotrypsin, pepsin, streptokinase, streptodornase, ficin, carboxy peptidase, aminopeptidase, chymopapain, bromelin and subtilisin. Particularly preferred is subtilisin, a general category of proteases produced by Bacillus sp. particular forms of which have been characterized and the DNA encoding them cloned and expressed (Wells, J. A., et al. *Nucleic Acids Res* (1983) 11:7911–7924). Particularly preferred forms of subtilisin which have been genetically engineered to be resistant to chemical oxidation have been reported by Estell, D. A., et al, *J. Biol Chem* (1985) 260:6518–6521). Mutated forms of the subtilisin containing cysteine in place of methionine at residue 222 had increased specific activity, although they were not oxidation resistant; alternative substitutions resulted in slightly decreased activity but greatly enhanced stability.

B. General Description

The invention concerns supplying the combination of a lys-C endoprotease and a suitable general protease in a composition suitable for contact lens cleaning. Clearly, the precise manner in which these two components are supplied is subject to considerable variation. The most convenient manner in which cleaning can be conducted is by means of a single solution containing both components. However, since the function of endoproteinase lys-C is presumably to "open up" the substrate lysozyme for attack by the protease, it may be desirable to pretreat the lenses with the endoproteinase and then to complete the hydrolysis with the general protease.

In general, the endoproteinase lys-C is supplied at a concentration of about 0.1–20 μg/ml in the cleaning compositions, and the concentration of the general protease is in the same range. Treatment times can vary from about 2 hours to about 15 hours, but a standard convenient cleaning time is overnight, so that the wearer can allow the lenses to soak while he sleeps. A variety of protocols are suitable, but ones that are particularly preferred are the use of a single solution containing both components conducted from 15 minutes to 2 hours or overnight at room temperature, or a 15 minute to 2 hour presoak in the presence of endoproteinase lys-C solution, followed by overnight treatment with the solution containing general purpose proteinase.

Preferred general purpose proteases include papain and subtilisin, in particular subtilisin as described above. Preferred endoproteinase lys-C enzyme is that from *Lysobacter enzymogenes.* A single protease may be used, or the composition may contain a mixture.

In addition, the compositions may include additional components which aid in the overall lysozyme degradation. Particularly useful among these are disulfide cleavage reagents such as 2-mercaptoethanol, cysteine hydrochloride, dithiothreitol, dithioerythritol, sodium bisulfate, sodium metabisulfite, thio urea, and the like, generally preferred in a range of about 0.01–5% by weight preferably 0.05–1% by weight. Since lysozyme contains four disulfide bonds, pretreatment with the disulfide-bond-breaking agent may also be preferred, although concomitant treatment with the proteinase is also workable. In addition, detergents may be included in the composition to aid in the wetting of the lens with the enzyme-containing solution. Suitable detergents include sodium dodecyl sulfate, sodium monolaurate, nonionic surfactants such as alcohol ethoxylates (e.g., polyethoxyethanol) aninoic surfactants such as ether sulfonates, linear alkylbenzene sulfonates, sodium lauryl sulfate, and the like.

Suitable buffers and stabilizers may also be used and include sodium or potassium citrate, citric acid, boric acid, sodium EDTA, various mixed phosphate buffers and $NaHCO_3$. Generally buffers and stabilizers may be used in amounts ranging from about 0.001 to about 2.5% and preferably about 0.01 to 1% by weight. It should be understood that the foregoing description of the amounts of the various compounds which may be used in the present invention are stated in percentage of ingredients in solution (wt/vol). The formulation may also take the form of one or more conventional solid dosage forms such as tablets suitble for use in a measured quantity of a suitable solvent such as water. The percentage composition of the solid dosage forms is such that when dissolved in a specified volume of water, the solution will have the percentage composition within the ranges set forth in the specification. If solid dosage forms are used, the formulation may include conventional lubricants, binders, and excipients which include glycerol, sorbitol, boric acid, propylene glycol, polyethylene glycols, dextran, methylcellulose, hydroxyethylcellulose, water soluble salts of carboxymethylcellulose, or naturally occurring hydrophilics such as gelatin, alginates, tragacanth, pectin, acacia and soluble starches.

Typical compositions and protocols useful in the method of the invention include the following:

1. The composition contains 5 μg/ml subtilisin and 5 μg/ml endoproteinase lys-C. The lenses are removed and placed in contact with the solution for a period of 12 hours at 22° C. The lenses are removed from the cleaning solution and rinsed in fresh water.

2. Solution A contains 10 μg/ml of endoproteinase lys-C; solution B contains 5 μg/ml subtilisin. The lenses are soaked in solution A for 30 minutes at 25° C., removed, and immersed in solution B for 10 hours at 25° C.

3. The cleaning solution contains 10 μg/ml of the protease pepsin and 10 μg/ml of endoproteinase lys-C. The lenses are soaked in this solution for 5 hours at 20° C.

4. The cleaning solution contains 5 μg/ml subtilisin, 5 μg/ml endoproteinase lys-C, and 10 mM 2-mercaptoethanol. The lenses are immersed in this solution for 5 hours at 30° C.

5. The cleaning solution contains 7 μg/ml subtilisin, 3 μg/ml endoproteinase lys-C, 10 mM 2-mercaptoethanol, and 2% sodium dodecyl sulfate (SDS). The lenses are soaked in this solution for 3 hours at 20° C.

6. The cleaning solution contains 4 μg/ml subtilisin, 2 μg/ml trypsin, 10 μg/ml endoproteinase lys-C, and 2% SDS. The lenses are soaked in this solution for 7 hours at 20° C.

7. Solution A contains 4 μg/ml subtilisin and 2 μg/ml trypsin in 2% SDS. Solution B contains 10 μg/ml endoproteinase lys-C plus 10 mM 2-mercaptoethanol. The lenses are immersed in solution B for 20 minutes at 30° C. and then in solution A for 6 hours at 25° C.

In all the foregoing examples, the lenses are thoroughly rinsed in saline before being returned to the wearer's eyes.

Contact lenses suitable for treatment according to the above protocols are typically classified as "soft" contact lenses. Compositions used to make these lenses are typically hydrophilic cross-linked polymers having a hydrogel structure or are made of silicone polymers. Typical compositions for such soft contact lenses are disclosed in U.S. Pat. No. 3,503,393 and U.S. Pat. No. 2,976,576. Generally speaking, although it is possible to apply these methods to hard contact lenses (those generally made of methacrylate or methylmethacrylate polymers), it is not especially advantageous to do so, as these hard contact lenses do not absorb large quantities of protein.

C. Examples

The following example is not intended to limit the invention, but is meant to illustrate the efficacy of the combination of endoproteinase lys-C treatment along with general proteinases.

C.1. Hydrolysis of Lysozyme Using Proteases and Endoproteinase Lys-C

The substrate solution contained 1 mg human milk lysozyme per ml in 0.025M Tris-HCl, pH 8. 0.5 ml of substrate solution was incubated with proteinase with and without endoproteinases at 37° C. (total volume 0.5 ml). The reaction was stopped by adding 0.5 ml of 20% TCA, and the reaction mixtures centrifuged to remove precipitated protein. Determination of extent of hydrolysis by is then made by measuring absorbance at 280 nm in the supernatant. The absorbance is directly related to the amount of lysozyme hydrolyzed. Blanks were prepared by adding TCA solution prior to adding protease/endoproteinase addition.

Some reaction mixtures additionally contained 2-mercaptoethanol, some samples were preincubated with the endoproteinase or other test endoproteinases before treatment with protease. Two separate determinations were made using different incubation times. For the results in Table 1, a 15 minute protease incubation time was used; for the results in Table 2, a 30 minute incubation time was used.

TABLE 1

| | Absorbance (280 nm) | Rel. Absorbance |
|---|---|---|
| 5 μg Subtilisin | 0.0177 | 1.00 |
| 5 μg Endoproteinase Lys-C | 0.0021 | 0.12 |
| 5 μg Trypsin | 0.0068 | 0.38 |
| 5 μg S-166 | 0.0131 | 0.74 |
| 5 μg Endoproteinase Lys-C + 5 μg Subtilisin | 0.0815 | 4.6 |
| 5 μg Trypsin + 5 μg Subtilisin | 0.0207 | 1.17 |
| 5 μg S-166 + 5 μg Subtilisin | 0.0155 | 0.87 |
| Preincubation with 5 μg Endoproteinase Lys-C for 15 min + 5 μg Subtilisin | 0.1466 | 8.28 |
| Preincubation with 5 μg Trypsin for 15 min + 5 μg Subtilisin | 0.0303 | 1.71 |
| Preincubation with 5 μg S-166 for 15 min + 5 μg Subtilisin | 0.0320 | 1.69 |

TABLE II

| | Absorbance (280 nm) | Rel. Absorbance |
|---|---|---|
| 5 μg Subtilisin | 0.0174 | 1.00 |
| 5 μg Endoproteinase Lys-C | 0.0096 | 0.56 |
| 5 μg Endoproteinase Arg-C | 0.0018 | 0.10 |
| 5 μg S-166 | 0.0125 | 0.73 |
| 5 μg Endopoteinase Lyc-C + 5 μg Subtilisin | 0.1386 | 8.10 |
| 5 μg Endoproteinase Arg-C + 5 μg Subtilisin | 0.0143 | 0.8 |
| 5 μg Endoproteinase Lys-C + 5 μg S-166 | 0.0585 | 3.42 |
| 5 μg Endoproteinase Arg-C + 5 μg S-166 | 0.0075 | 0.44 |
| Endoproteinase Lys-C + 0.4% 2-mercaptoethanol + 5 μg Subtilisin | 0.1080 | 6.31 |
| Endoproteinase Arg-C + 0.4% 2-mercaptoethanol + 5 μg Subtilisin | 0.0711 | 4.16 |

TABLE II-continued

| | Absorbance (280 nm) | Rel. Absorbance |
|---|---|---|
| Subtilisin | | |

(S-166 refers to a mutant enzyme of subtilisin with serine at position 166 in place of glycine.)

The results in Table 1 show that, as compared with hydrolysis with subtilisin alone, the addition of endoproteinase lys-C provided a 4.6-fold increase, and incubation along with trypsin provided a slight increase. Preincubation with the protease S-166, trypsin, or endoproteinase lys-C all enhanced the hydrolysis of lysozyme, but a dramatic 8-fold increase was found when endoproteinase lys-C was used.

The results in Table 2 similarly showed that an enhancement (approximately 8-fold) was obtained when endoproteinase lys-C was added to the subtilisin solution. On the other hand, the combination of endoproteinase arg-C with subtilisin was relatively ineffective. However, when these two endoproteinases were used in the presence of 0.4% 2-mercaptoethanol, the addition of endoproteinase arg-C was effective in enhancing hydrolysis, although still not as dramatically as the increase effected by endoproteinase lys-C. The combination of endoproteinase lys-C with S-166 also gave an increase in lysozyme hydrolysis.

We claim:

1. A method to clean contact lenses, which method comprises treating said lenses with from 0.1 to 20 μg/ml of a protease selected from the group consisting of:

papain, pancreatin, trypsin, chymotrypsin, pepsin, streptokinase, streptodornase, ficin, carboxypeptidase, aminopeptidase, chymopapain, bromelin and subtilisin and with from 0.1 to 20 μg/ml of an endoproteinase lys-C.

2. The method of claim 1 wherein the protease is subtilisin.

3. The method of claim 1 wherein the protease is papain.

4. The method of claim 1 wherein the endoproteinase lys-C is derived from *Lysobacter enzymogenes.*

5. The method of claim 2 wherein the subtilisin is resistant to oxidation.

6. The method of claim 1 wherein the treatment with endoproteinase lys-C and with protease is simultaneous.

7. The method of claim 1 wherein the lens is pretreated with endoproteinase lys-C and subsequently treated with protease.

8. The method of claim 1 wherein which further includes treating the lens with a disulfide cleavage reagent.

9. A composition for cleaning soft contact lenses which comprises (1) a protease selected from the group consisting of: papain, pancreatin, trypsin, chymotrypsin, pepsin, streptokinase, streptodornase, ficin, carboxypeptidase, aminopeptidase, chymopapain, bromelin and subtilisin in a concentration of from 0.1 to 20 μg/ml;

and (2) endoproteinase lys-C in a concentration of from 0.1 to 20 μg/ml.

10. The composition of claim 9 wherein the protease is subtilisin.

* * * * *